United States Patent [19]

Saito et al.

[11] Patent Number: 4,627,402

[45] Date of Patent: Dec. 9, 1986

[54] METHOD AND APPARATUS FOR CONTROLLING AIR-FUEL RATIO IN INTERNAL COMBUSTION ENGINE

[75] Inventors: Kimitaka Saito; Kenzi Iwamoto, both of Nishio; Tsuneyuki Egami, Gamagori; Tsutomu Saito, Okazaki; Takesi Matuyama, Aichi, all of Japan

[73] Assignee: Nippon Soken, Inc., Nishio, Japan

[21] Appl. No.: 797,815

[22] Filed: Nov. 13, 1985

[30] Foreign Application Priority Data

Nov. 14, 1984 [JP] Japan ..... 59-238590

[51] Int. Cl.[4] ..... F02B 33/00

[52] U.S. Cl. ..... 123/440; 123/489

[58] Field of Search ..... 123/489, 440

[56] References Cited

U.S. PATENT DOCUMENTS 4,111,171 9/1978 Aono ..... 123/440

4,337,745 7/1982 Pomerantz ..... 123/440

4,483,300 11/1984 Hosaka et al. ..... 123/440

*Primary Examiner*—Ronald B. Cox

*Attorney, Agent, or Firm*—Cushman, Darby & Cushman

[57] ABSTRACT

In an internal combustion engine having a plurality of cylinders, an air-fuel ratio signal is sampled and held for a selected cylinder, and an air-fuel ratio feedback amount is calculated in accordance with the sampled and held air-fuel ratio signal. During a learning control, a cylinder on the leanest side is determined by changing the selected cylinder. During a feedback control without the learning control, the selected cylinder is fixed as the cylinder on the leanest side.

10 Claims, 18 Drawing Figures

10
108
CLK
107
CPU
109
RAM
110
ROM
111
OUTPUT PORT
112
DOWN COUNTER
113
S Q R
114
DRIVER CIRCUIT
4
FUEL INJECTION VALVE
101
TIMING GEN. CIRCUIT
SHT
104
INPUT PORT
106
A/D
103
VR
102
S/H
105
MPX
TRG
720°CA
30°CA
8
CRANK ANGLE SENSOR
9
CRANK ANGLE SENSOR
6
O2 SENSOR
3
AFM

LEARNING CONTROL ROUTINE
$f_j \leftarrow V(F)$
701
$j \leftarrow j+1$
702
$j > 4$ ?
703
NO
YES
$AVF_i \leftarrow (f_1+f_2+f_3+f_4)/4$
704
$i \leftarrow i+1$
705
$i < 6$ ?
706
NO
YES
$SHT \leftarrow f_{MAP}(i,Q,Ne)$
707
RETURN
718

METHOD AND APPARATUS FOR CONTROLLING AIR-FUEL RATIO IN INTERNAL COMBUSTION ENGINE

BACKGROUND OF THE INVENTION

1. Field of the Invention

The present invention relates to a method and apparatus for feedback control of the air-fuel ratio in an internal combustion engine having a plurality of cylinders.

2. Description of the Related Art

Generally, in a feedback control of the air-fuel ratio, a base fuel amount TAUP is calculated in accordance with the detected intake air amount and the detected engine speed, and the base fuel amount TAUP is corrected by an air-fuel ratio feedback amount V(F) which is calculated in accordance with the output signal of an air-fuel ratio sensor (for example, an $O_2$ sensor or a lean mixture sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio or a predetermined lean air-fuel ratio. According to this feedback control, the center of the controlled air-fuel ratio can be within a very small range of air-fuel ratios around the stoichiometric ratio or the predetermined lean air-fuel ratio.

On the other hand, in an engine having a plurality of cylinders where fuel injection is carried out by electronic fuel injectors each provided for the cylinders, even when each of the fuel injectors are activated by the same injection signal, the fuel amount characteristics of each fuel injector are fluctuated as a result of the individual differences in the parts of the fuel injectors, the long-term changes thereof, and the like. Also, the larger the fuel pressure of a fuel injector, the larger the fuel amount injected by the fuel injector. Therefore, if there are differences in the fuel pressure between the fuel injectors, the fuel amount characteristics of each fuel injector are also fluctuated. Further, the intake air amount characteristics of each cylinder are fluctuated as a result of the individual differences in the structure of an intake air pipe, the opening and closing timing of an intake valve and an exhaust valve, the residual exhaust gas amount within the combustion chambers, the intake air density dependent upon the temperature distribution of the engine, and the like. In addition, the intake air amount characteristics of each cylinder are fluctuated as a result of the fluctuation within an intake air pipe due to the operation of the exhaust gas recirculation system, the ventilation system of a crank case, the evaporation system, the idling engine speed control system, or the like. Thus, in an engine having a plurality of cylinders, it is actually impossible to avoid the fluctuation of the air-fuel ratio between the cylinders due to the fluctuation of the fuel amount characteristics and the intake air amount characteristics thereof.

However, in the above-mentioned prior art air-fuel ratio feedback control system, since air-fuel ratio feedback control is performed simultaneously upon the entire bank of the cylinders, so that the mean air-fuel ratio of the cylinders is brought close to a stoichiometric air-fuel ratio or a predetermined lean air-fuel ratio, the emission characteristics, such as the $NO_x$ component characteristics, the idling stability, and the like are deteriorated, due to the fluctuation of the air-fuel ratio between the cylinders.

SUMMARY OF THE INVENTION

It is an object of the present invention to provide a method and apparatus for controlling the air-fuel ratio in an internal combustion engine having a plurality of cylinders which can improve the emission characteristics, the idling stability, and the like, regardless of the fluctuation of the air-fuel ratio between the cylinders.

According to the present invention, in an internal combustion engine, having a plurality of cylinders, an air-fuel ratio signal is sampled and held for a selected cylinder, and an air-fuel ratio feedback amount is calculated in accordance with the sampled and held air-fuel ratio signal. During a learning control, a cylinder on the leanest side is determined by changing the selected cylinder. During a feedback control without the learning control, the selected cylinder is fixed as the cylinder on the leanest side. Thus, during a feedback control without the learning control, air-fuel ratio feedback control is carried out on the basis of the cylinder on the leanest side, so that the controlled air-fuel ratio is close to a leaner side.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
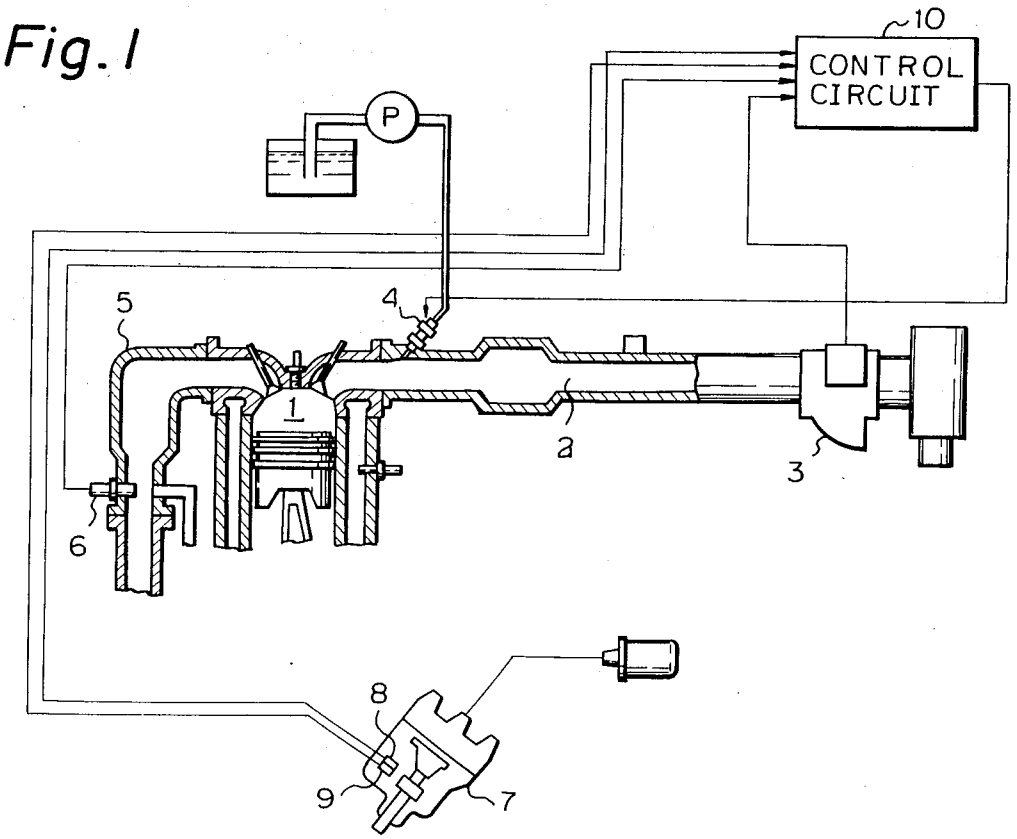
FIG. 1 is a schematic view of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometertype airflow meter 3 for detecting the amount of air taken into the engine 1 to generate an analog voltage signal in proportion to the amount of air flowing therethrough. The signal of the airflow meter 3 is transmitted to a control circuit 10. Additionally provided in the air-intake passage 2 is a fuel injector 4 for supplying pressurized fuel from the fuel system to the air-intake port of the cylinder of the engine 1. In this case, other fuel injectors are also provided for other cylinders, though not shown in FIG. 1.

Provided in an exhaust gas passage 5 of the engine 1 is a three-way reducing and oxidizing catalyst converter (not shown) which removes three pollutants CO, HC, and $NO_x$ simultaneously in the exhaust gas. Also provided upstream of the three way converter is an $O_2$ sensor 6 for detecting the concentration of oxygen composition in the exhaust gas. The $O_2$ sensor 6 generates an output voltage signal and transmits it to the control circuit 10.

Disposed in a distributor 7 are crank angle sensors 8 and 9 for detecting the angle of the crank-shaft (not shown) of the engine 1. In this case, the crank-angle sensor 8 generates a pulse signal at every 720° crank angle (CA) while the crank-angle sensor 9 generates a pulse signal at every 30° CA. The pulse signals of the crank angle sensors 8 and 9 are supplied to the control circuit 10.

Figure 2:
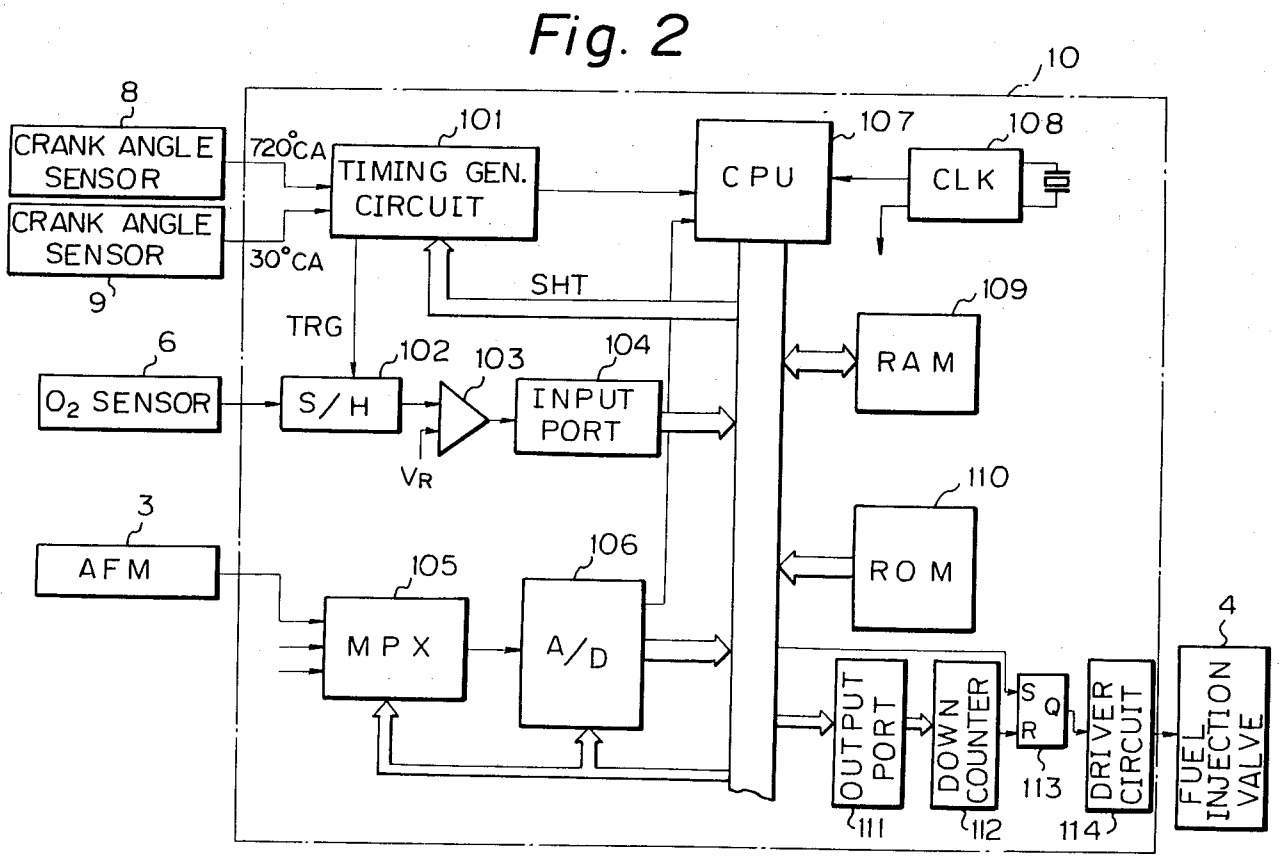
FIG. 2 is a detailed block circuit diagram of the control circuit of FIG. 1.
Figure 3:
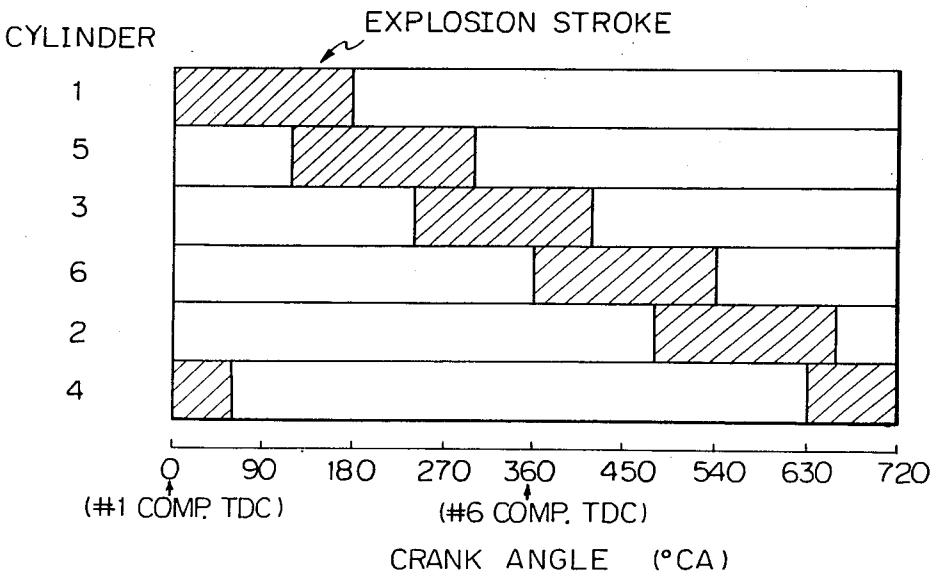
FIG. 3 is a timing diagram showing the explosion strokes of the cylinders of FIG. 1.

In FIG. 2, which is a detailed block circuit diagram of the control circuit 10 of FIG. 1, reference numeral 101 designates a timing generating circuit which receives the 720° CA signal (cylinder determination signal) of the crank angle sensor 8 and the 30° CA signal (rotational angle signal) of the crank angle sensor 9, and generates an interrupt signal and transmits it to a central processing unit (CPU) 107. Also, the timing generating circuit 101 generates a trigger signal TRG in accordance with sample-and-hold timing data SHT from the CPU 107, and supplies it to a sample-and-hold circuit 102. Note that the sample-and-hold data SHT is used for fetching an air-fuel ratio signal corresponding to a selected cylinder (strictly, the explosion stroke thereof) as shown in FIG. 3, and is set by a routine which will be later explained.

The output of the $O_2$ sensor 6 is sampled and held by the sample-and-hold circuit 102, and is then compared with a reference voltage $V_R$ such as 0.45 V by a comparator 103. As a result, when the output voltage of the sample-and-hold circuit 102 is higher than the reference voltage $V_R$, the comparator 103 generates a logic "1" level signal, while when the output voltage of the sample-and-hold circuit 102 is not higher than the reference voltage $V_R$, the comparator 103 generates a logic "0" level signal. The output signal of the comparator 103 is supplied to an input port 104.

The output voltage of the airflow meter 3 is supplied via a multiplexer 105 to an analog-to-digital (A/D) converter 106.

The control circuit 10, which may be constructed by a microcomputer, further comprises a clock generator 108 for generating various clock signals, a random access memory 109 (RAM) for storing temporary data, a read-only memory (ROM) 110 for storing a main routine, interrupt routines such as a fuel injection routine, an ignition timing routine, tables (maps), constants, etc., an output port 111, a down counter 112, a flip-flop 113, a driver circuit 114, and the like.

The output port 111, the down counter 112, the flip-flop 113, and the driver circuit 114 are used for controlling the fuel injector 4. That is, when a fuel injection amount TAU is calculated in a TAU routine, which will be later explained, the amount TAU is preset in the down counter 112, and simultaneously, the flip-flop 113 is set. As a result, the driver circuit 114 initiates the activation of the fuel injector 4. On the other hand, the down counter 112 counts up the clock signal from the clock generator 108, and finally generates a logic "1" signal from the carry-out terminal thereof, to reset the flip-flop 113, so that the driver circuit 114 stops the activation of the fuel injector 4. Thus, the amount of fuel corresponding to the fuel injection amount TAU is injected into the fuel injector 4.

Interruptions occur at the CPU 107, when the clock generating circuit 101 generates an interrupt signal; when the A/D converter 106 completes an A/D conversion and generates an interrupt signal; when the crank angle sensor 13 generates a pulse signal; and when the clock generator 108 generates a special clock signal.

The intake air amount data Q of the airflow meter 3 is fetched by an A/D conversion routine executed at every predetermined time period and is then stored in the RAM 109. That is, the data Q in the RAM 109 are renewed at every predetermined time period. The engine speed Ne is calculated by an interrupt routine executed at 30° CA, i.e., at every pulse signal of the crank angle sensor 9, and is then stored in the RAM 109.

The operation of the control circuit 10 of FIG. 2 will be explained with reference to FIGS. 4 through 14.

Figure 4:
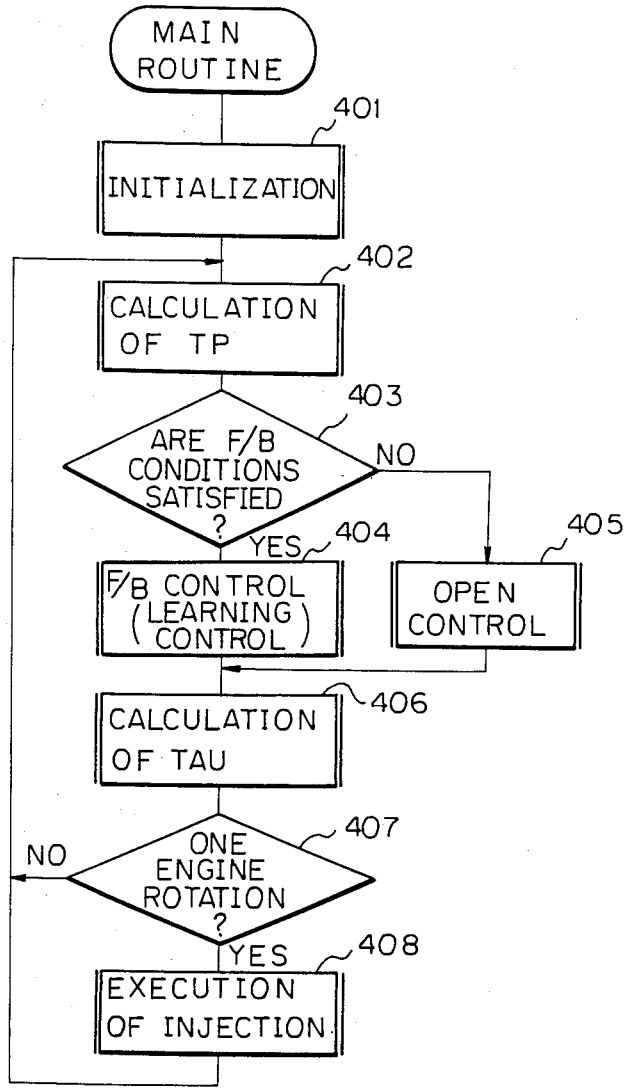
FIGS. 4 through 7, 7A, 7B, 10, and 11 are flowcharts showing the operation of the control circuit of FIG. 1.

In FIG. 4, which is a main routine for carrying out electronically controlled fuel injection, the program enters into step 401 by turning on the ignition switch (not shown). At step 402, the input port 104, the RAM 109 the output port 111, and the like are initialized. At step 603, a base fuel injection amount TP is calculated from data Q of the intake air amount and data Ne of the engine speed. That is, $$TP \leftarrow K_1 Q/Ne$$

where $K_1$ is a constant.

At step 403, it is determined whether or not all the feedback control (closed-loop control) conditions are satisfied. The feedback control conditions are as follows:

(i) the engine is not in a starting state;

(ii) the coolant temperature THW is higher than 50° C.; and (iii) the power fuel increment FPOWER is 0.

Of course, other feedback control conditions are introduced as occasion demands. However, an explanation of such other feedback control conditions is omitted.

If one or more of the feedback control conditions is not satisfied, the program proceeds to step 405 which carries out an open-loop control operation. That is, an air-fuel ratio feedback amount V(F) is caused to be a predetermined value such as 1.0. Note that, in an open control, no operation can be carried out, and in this case, the air-fuel ratio feedback amount V(F) remains at the final value during an air-fuel ratio feedback control period. Contrary to this, if all the feedback control conditions are satisfied, the program proceeds to step 404 which carries out an air-fuel ratio feedback control operation, which will be later explained.

At step 506, a final fuel injection amount TAU is calculated by:

$$TAU \leftarrow TP \cdot V(F)\alpha + \beta$$

where $\alpha$ and $\beta$ are other correction amounts determined by a warming-up increment, an intake air temperature correction amount, a transient fuel correction amount, a power supply voltage correction amount, and the like. At step 407, it is determined whether or not one rotation of the engine 1 is detected. As a result, at every one rotation of the engine 1, the program proceeds to step 408 which sets the fuel injection amount TAU in the down counter 112, and simultaneously, sets the flip-flop 113 to initiate the activation of the fuel injector 4. Then, as explained above, when a time period corresponding to the amount TAU passes, the flip-flop 113 is reset by the carry-out signal of the down counter 112 to stop the activation of the fuel injector 4.

Note that the determination at step 407 can be carried out by reading a flag of the RAM 109, which is set by an interrupt signal (360° CA) from the timing generating circuit 101.

The program returns to step 402, thereby repeating the above-mentioned operations.

Figure 5:
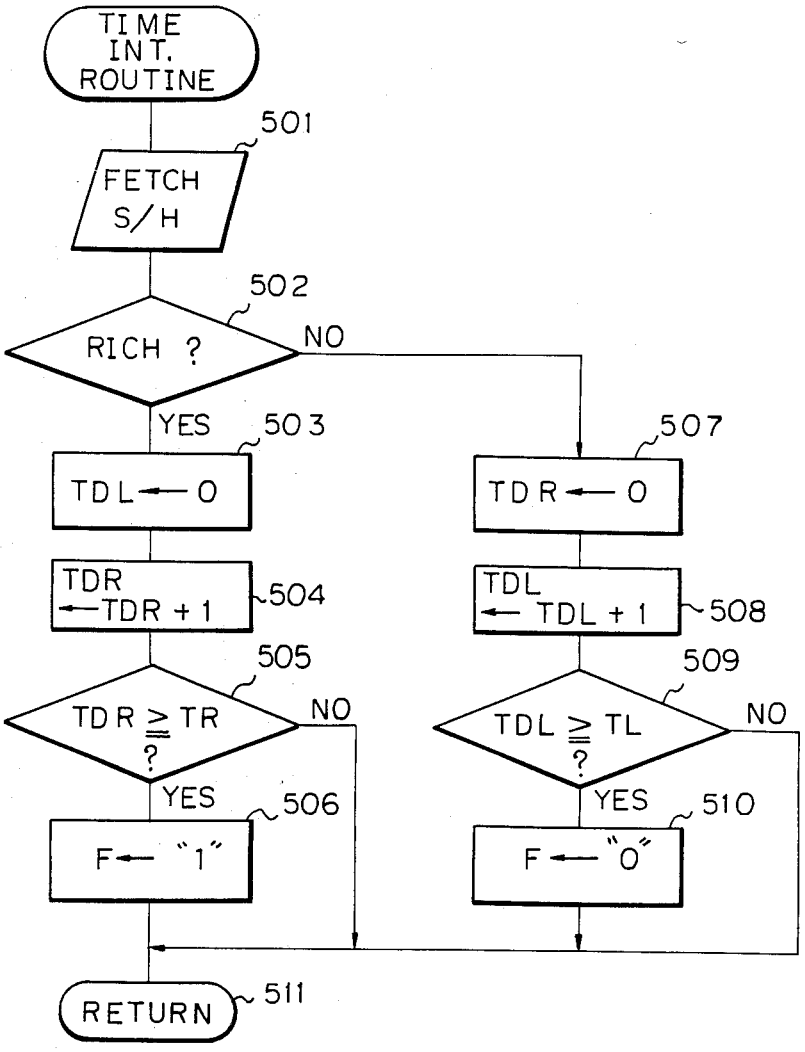

FIG. 5 shows a routine for processing the output of the $O_2$ sensor 6, i.e., the output of the sample-and-hold circuit 102, executed at every predetermined time period such as 4 ms. At step 501, the output of the sample-and-hold circuit 102 is fetched via the comparator 103, and at step 502, it is determined whether or not the air-fuel ratio of the engine is rich or lean. Note that the logic "1" and "0" level signals of the comparator 103 represent the rich and lean states, respectively. If the air-fuel ratio is rich ("1"), the program proceeds to step 503 which clears a lean delay counter TDL for detecting the lean air-fuel ratio, and further proceeds to step 504 which counts up a rich delay counter TDR for detecting the rich air-fuel ratio. Then, at step 505, it is determined whether or not the value of the rich delay counter TDR is larger than or equal to a predetermined value TR. As a result, if TDR>TR, this means that the rich state is established, and accordingly, at step 506, a rich detection flag F is set. Contrary to this, at step 502, if the air-fuel ratio is lean, the program proceeds to step 507 which clears the rich delay counter TDR, and further proceeds to step 508 which counts up the lean delay counter TDL. Then, at step 509, it is determined whether or not the value of the lean delay counter TDL is larger than or equal to a predetermined value TL. As a result, if TDL>TL, this means that the lean state is established, and accordingly, at step 610, the rich detection flag F is reset. Then this routine is completed by step 511.

According to the routine of FIG. 5, even when the output of the sample-and-hold circuit 102 is changed from lean to rich, the rich detection flag F is caused to be "1" only after the rich state of the output of the sample-and-hold circuit 102 continues for the delay time period TR. Similarly, even when the output of the sample-and-hold circuit 102 is changed from rich to lean, the lean detection flag F is caused to be "0" only after the lean state of the output of the sample-and-hold circuit 102 continues for the delay time period TL. The process shown by the routine of FIG. 5 is a so-called delay process for stabilizing the air-fuel ratio feedback control. In addition, the delay time periods TL and TR are adjusted so that the control center of the air-fuel ratio of the $O_2$ sensor 6 substantially conforms to the control center of the three-way catalyst converter.

Figure 6:
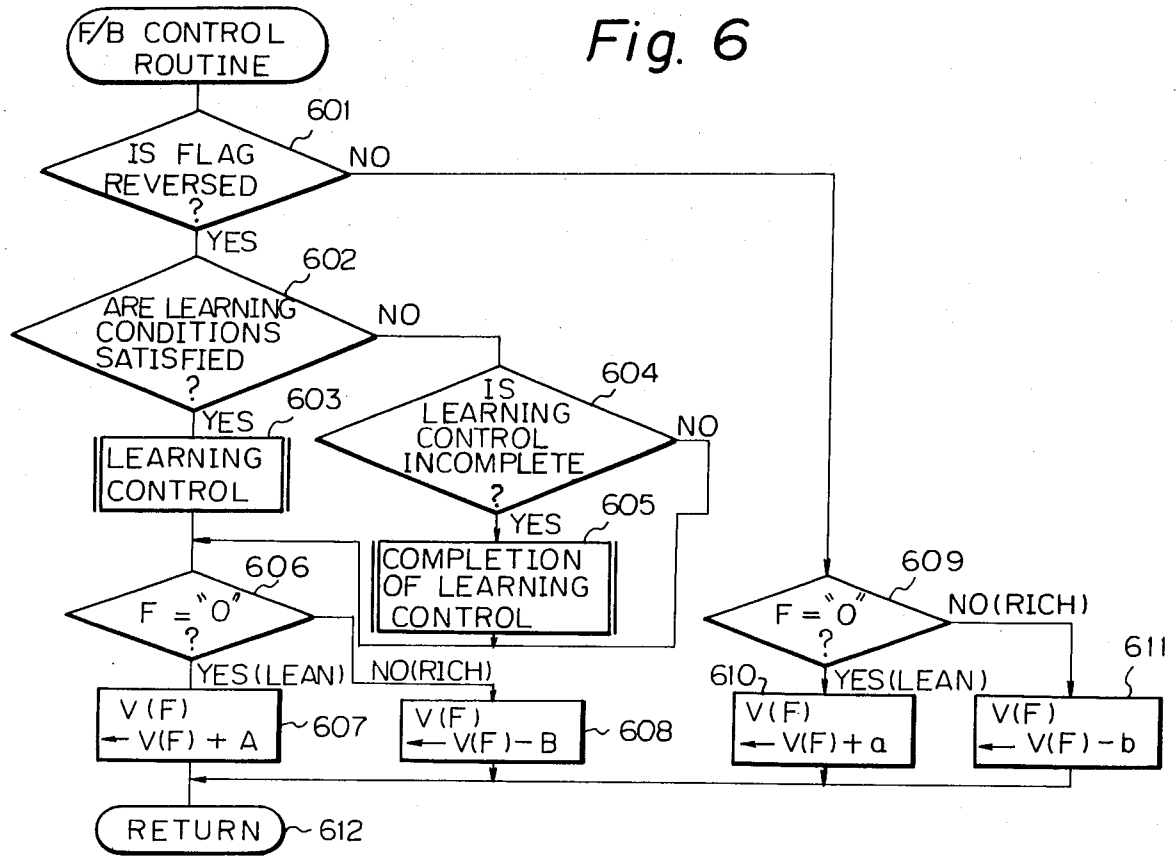

In FIG. 6, which is a detailed flowchart of the air-fuel feedback step 404 of FIG. 4, at step 601, it is determined whether or not the rich detection flag F is reversed, i.e., whether or not the delayed air-fuel ratio is reversed. If the rich detection flag F is reversed, the program proceeds to step 602, otherwise the program proceeds to step 609.

At step 609, it is determined whether or not all the learning control conditions are satisfied. The learning control conditions are as follows:

(i) the coolant temperature THW is higher than 60° C. and the engine is in an idling state; or (ii) the coolant temperature THW is higher than 60° C. and $\Delta Q/Ne \leqq 0.01$ l/rev is satisfied.

Of course, other learning control conditions are introduced as occasion demands. However, an explanation of such other learning control conditions is omitted.

If all the learning control conditions are satisfied, the program proceeds to step 603 which carries out a learning control operation, while if one of the learning control conditions are not satisfied, the program proceeds to step 604 which determines whether or not the learning control operation is incomplete. If a learning control operation is incomplete, the program proceeds to step 605 which completes such a learning control operation.

Also, when the rich detection flag F is reversed, a skip operation is carried out. That is, at step 606, it is determined whether the rich detection flag F is "0" (lean) or "1" (rich). As a result, if the air-fuel ratio is lean, the program proceeds to step 607 which remarkably increases the air-fuel ratio feedback amount V(F) by a relatively large amount A, while if the air-fuel ratio is rich, the program proceeds to step 608 which remarkably decreases the air-fuel ratio feedback amount V(F) by a relatively large amount B.

On the other hand, when the rich detection flag F is not reversed, an integration operation is carried out. That is, at step 609, it is determined whether the rich detection flag F is "0" (lean) or "1" (rich). As a result, if the air-fuel ratio is lean, the program proceeds to step 610 which gradually increases the air-fuel ratio feedback amount V(F) by a relatively small amount a (<A), while if the air-fuel ratio is lean, the program proceeds to step 611 which gradually decreases the air-fuel ratio feedback amount V(F) by a relatively small amount b (<B).

Then, the routine of FIG. 6 is completed by step 612.

The learning control step 603 and the learning control completion step 605 of FIG. 6 will be explained.

Figures 7, 7A, 7B:
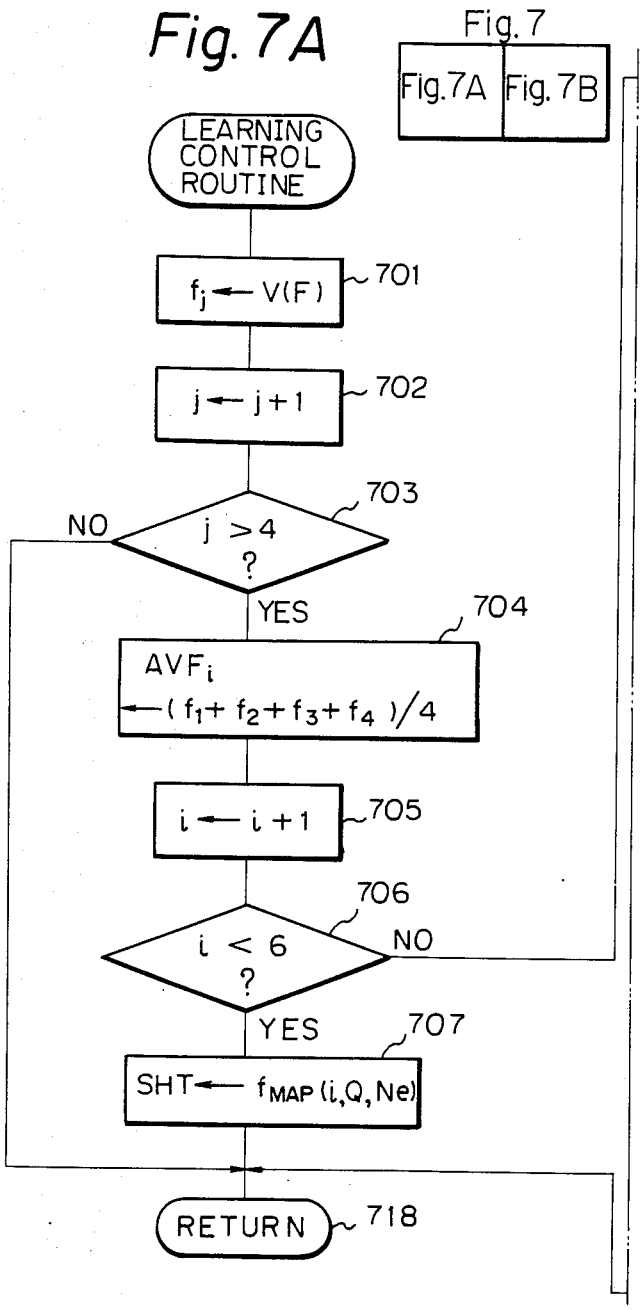
Figure 7B:
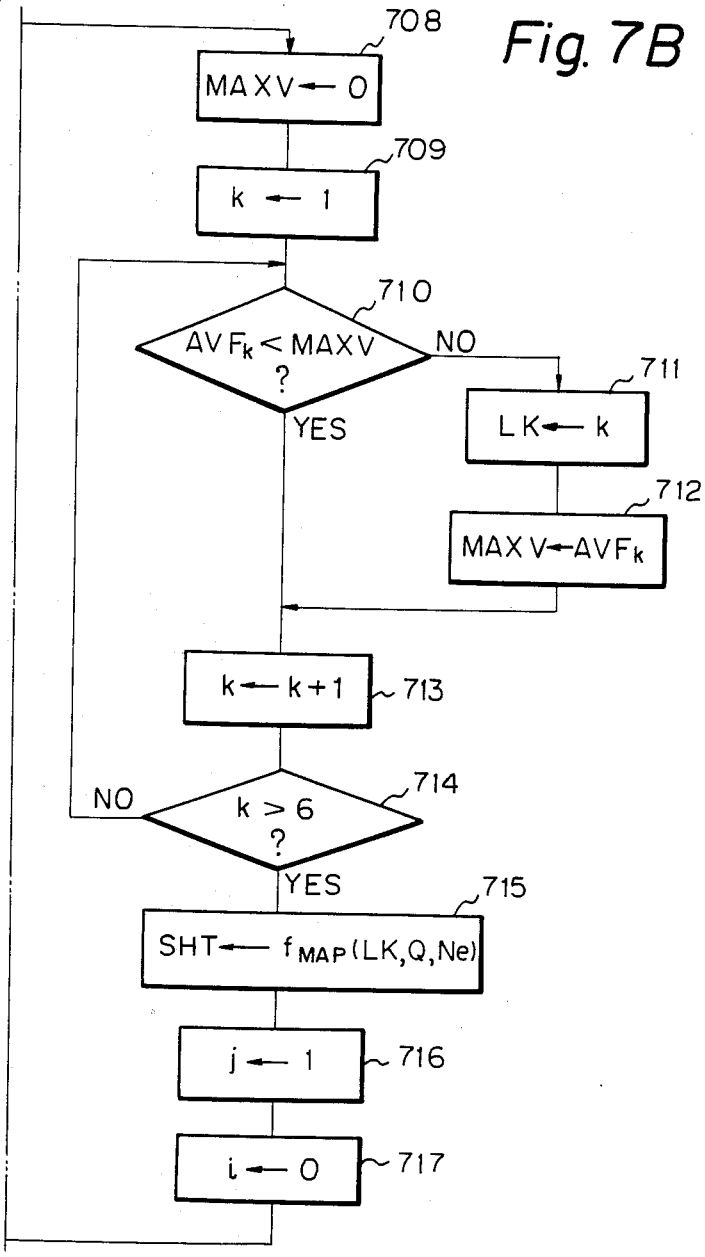

In FIG. 7, which is a detailed flowchart of the learning control step 603 of FIG. 6, a cylinder on the leanest side is determined by detecting the maximum of the air-fuel ratio feedback amount V(F), so that an air-fuel feedback control operation with no learning control operation is carried out by using the air-fuel ratio feedback amount V(F) for the cylinder on the leanest side. As explained above, this step is carried out at every skip operation when all the learning control conditions are satisfied. Note that counters i and j are initially set at 0 and 1, respectively.

At step 701, $f_j \leftarrow V(F)$. Then, at step 702, the counter j is counted up by +1, and at step 703, it is determined whether or not j>4 is satisfied. If j>4, then the program proceeds to step 704 which calculates a mean air-fuel ratio feedback amount $AVF_i$ by $$AVF_i \leftarrow (f_1+f_2+f_3+f_4)/4.$$

That is, the value $AVF_i$ is a mean value of four successive air-fuel ratio feedback amounts V(F) immediately before four successive skip operations. Note that the value $AVF_i$ can be calculated from two or more successive amounts V(F).

At step 705, the counter i is counted up by +1, and at step 706, it is determined whether or not i<6 is satisfied. Here, note that the engine has six cylinders.

Figure 8:
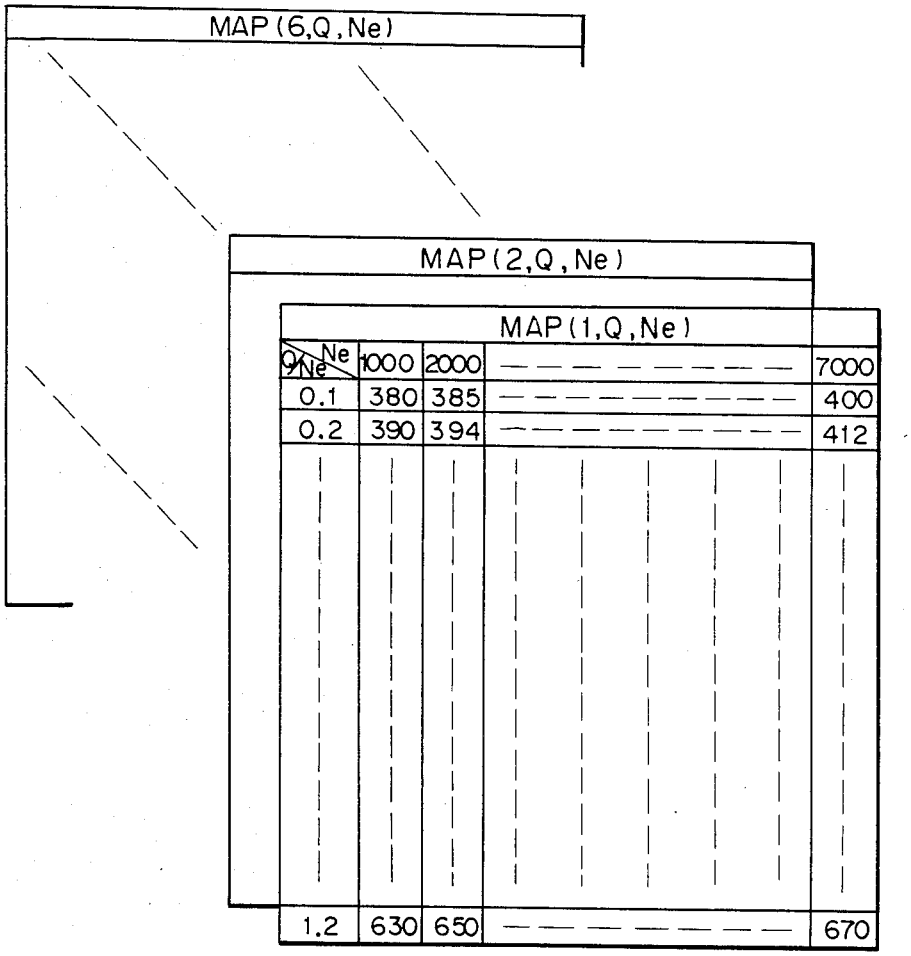
FIG. 8 is a diagram showing the maps used at step 715 of FIG. 7.

If i<6 at step 706, the program proceeds to step 707 which advances a synchronizing timing SHT for the next cylinder. That is, a synchronizing timing SHT is calculated from a two-dimensional map $f_{MAP}$ (i, Q, Ne) of the air-fuel ratio output timing corresponding to the explosion stroke of each cylinder as shown in FIG. 8, and is stored in the RAM 109.

Figure 9:
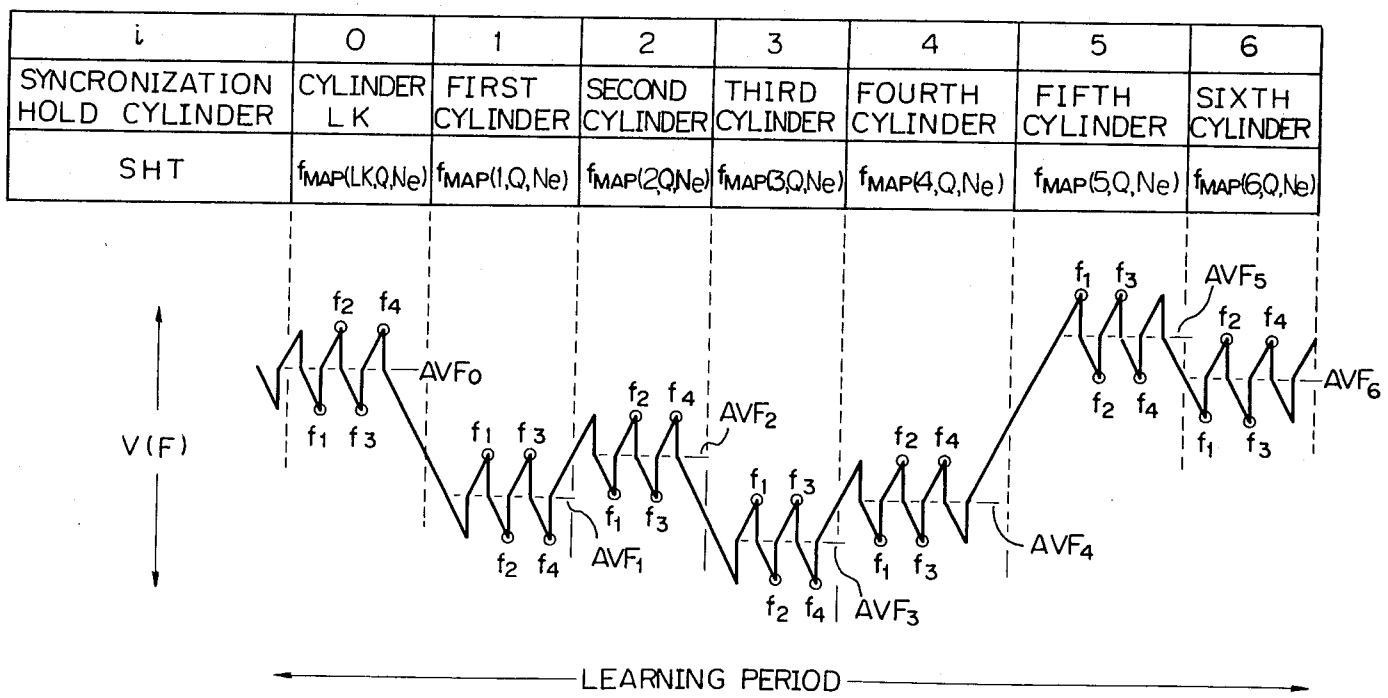
FIG. 9 is a timing diagram showing the air-fuel feedback amount V(F) during a learning period according to the present invention.

Therefore, when the learning control operation continues, the mean value $AVF_i$ (i=0 to 6) of the air-fuel ratio feedback amount V(F) for the synchronized cylinder i (i=0 to 6) is obtained as illustrated in FIG. 9. Note that, when i=0, the synchronized cylinder is a cylinder on the leanest side (hereinafter referred to as leanest cylinder) determined during a previous learning time period.

When $i \geqq 6$ at step 706, the program proceeds to steps 708 through 715 thereby renewing a cylinder on the leanest side. In this case, such a renewal is carried out by detecting a maximum value from the mean values $AVF_1$, $AVF_2$, . . . , and $AVF_6$ for the six cylinders. That is, at step 708, a maximum value MAXV is cleared, and at step 709, a counter k is caused to be 1. Then, at step 710, it is determined whether or not the mean value $AVF_1$ for the first cylinder satisfies $AVF_1 < MAXV$. If $AVF_1 \geqq MAXV$, at step 711, a leanest cylinder counter LK is caused to be 1, and in addition, at step 712, the maximum value MAXV is caused to be $AVF_1$. The steps 710 to 712 are repeated for the other cylinders by steps 713 and 714. Finally, the leanest cylinder, i.e., the counter LK is determined, and its maximum value $AVF_k$ (k=LK) is determined. For example, if the air-fuel ratio feedback amount V(F) is changed as shown in FIG. 9, the mean value of the air-fuel ratio feedback amount V(F) is maximum when the synchronized cylinder is the fifth cylinder. Therefore, in this case, $LK \leftarrow 5$ and $MAXV \leftarrow AVF_5$.

Thus, after the leanest cylinder is determined, the program proceeds to step 715 which calculates a synchronized timing SHT for the leanest cylinder from a two-dimensional map $f_{MAP}$ (LK, Q, Ne).

Then, at step 716, the counter j is caused to be 1, and at step 717, the counter i is caused to be 0. This routine is completed by step 718.

In this state, if one of the learning control conditions is not satisfied, the synchronized timing SHT is fixed for the leanest cylinder, and accordingly, air-fuel ratio feedback control is carried out on the basis of the leanest cylinder.

If a learning control operation is incomplete at the time when one of the learning controls is not satisfied, renewal of a leanest cylinder by steps 708 through 715 is not carried out. In this case, in FIG. 6, the program at step 602 proceeds to step 604, and further proceeds to step 605. Note that the determination at step 604 is carried out by determining whether or not $i \geqq 1$ is satisfied.

Figure 10:
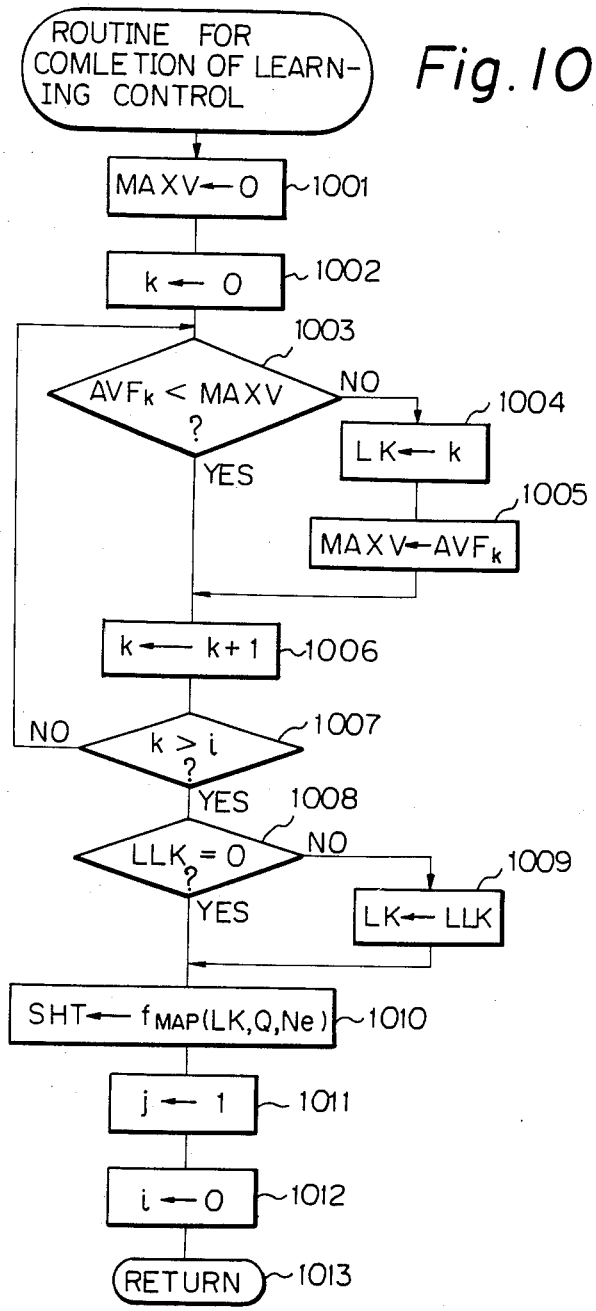

FIG. 10 is a detailed flowchart of the learning control completion step 605 of FIG. 6. For example, if i=5 at step 604, this means that the mean value $AVF_0$ for the leanest cylinder and the mean values $AVF_1$ through $AVF_4$ are already calculated. In this case, renewal of a leanest cylinder is carried out by detecting a maximum value from the mean values $AVF_1$ through $AVF_4$ including the mean value $AVF_0$ for the leanest cylinder determined at a previous learning control cycle. That is, at step 1001, the maximum value MAXV is cleared, and at step 1002, the counter k is caused to be 1. Then, at step 1003, it is determined whether or not the mean value $AVF_0$ for the previous leanest cylinder satisfies $AVF_0 < MAXV$. If $AVF_0 \geqq MAXV$, at step 1004, a leanest cylinder counter LLK is caused to be 0, and in addition, at step 1005, the maximum value MAXV is caused to be $AVF_0$. The steps 1003 to 1005 are repeated for the first through fourth cylinders by steps 1006 and 1007. Finally, the leanest cylinder, i.e., the counter LLK is determined, and its maximum value $AVF_k$ (k=LLK) is determined. For example, if the air-fuel ratio feedback amount V(F) is changed as shown in FIG. 9, the mean value of the air-fuel ratio feedback amount V(F) is maximum when the synchronized cylinder is the previous leanest cylinder. Therefore, in this case, the leanest cylinder is unchanged.

At step 1008, it is determined whether or not the leanest cylinder is changed. Only when the leanest cylinder is changed ($LLK \neq 0$), does the program proceed to step 1009 in which $LK \leftarrow LLK$.

Thus, after the leanest cylinder is determined, the program proceeds to step 1010 which calculates a synchronized timing SHT for the renewed leanest cylinder from a two-dimensional map $f_{MAP}$(LK, Q, Ne). Then, at step 1011, the counter j is caused to be 1, and at step 1012, the counter i is caused to be 0. This routine is completed by step 1013.

Also in this state, if one of the learning control conditions is not satisfied, the program flow at steps 602 and 604 proceeds to step 606. Therefore, the synchronized timing SHT is fixed for the leanest cylinder, and accordingly, air-fuel ratio feedback control is carried out on the basis of the leanest cylinder.

Figure 11:
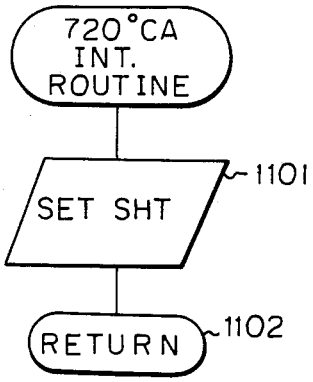

FIG. 11 is an interrupt routine executed by every 720° CA. That is, the timing generating circuit 101 generates an interrupt signal upon receipt of every cylinder determination signal, and transmits it to the CPU 107, thereby initiating the routine of FIG. 11. At step 1101, sample-and-hold timing data SHT is read from the RAM 109 and is set in the timing generating circuit 101. Thus, the routine of FIG. 11 is completed by step 1102.

Figure 12:
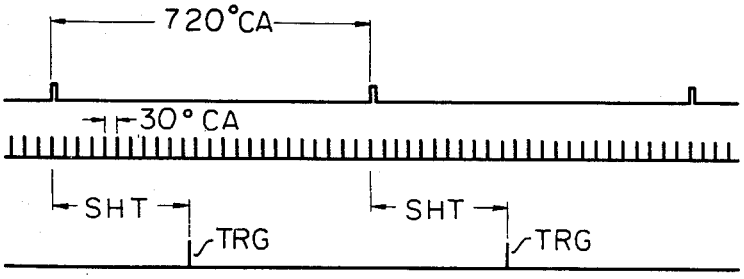
FIG. 12 is a timing diagram complementarily explaining the flowchart of FIG. 11.
Figure 13:
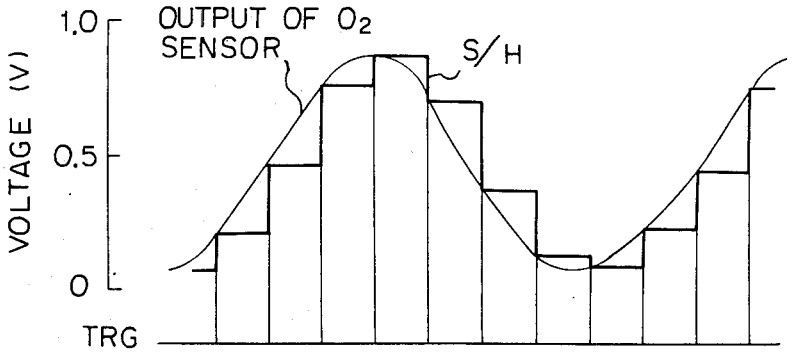
FIG. 13 is a timing diagram showing the output voltage of the sample-and-hold circuit of FIG. 2.

As illustrated in FIG. 12, when a time period corresponding to SHT elapses after the sample-and-hold timing data SHT is set in the timing generating circuit 101 by the routine of FIG. 11, the timing generating circuit 101 generates a trigger signal TRG and transmits it to the sample-and-hold circuit 102. That is, as illustrated in FIG. 13, which shows the relationship between the output voltage S/H of the sample-and-hold circuit 102 and the output voltage of the $O_2$ sensor 6 of FIG. 2, the sample-and-hold circuit 102 holds the output voltage of the $O_2$ sensor 6 until the sample-and-hold circuit 102 receives a next trigger signal TRG.

Figure 14:
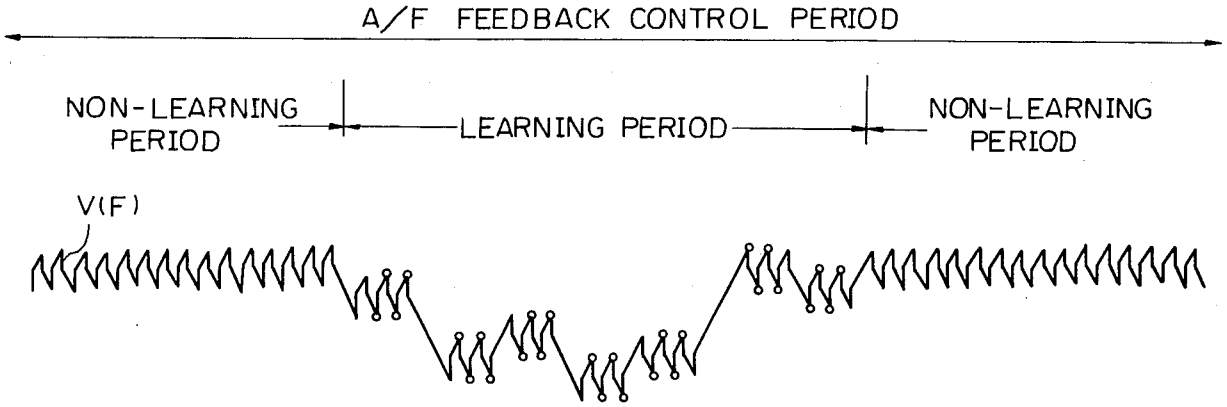
FIG. 14 is a timing diagram of the air-fuel feedback amount V(F) according to the present invention.

Thus, according to the present invention, the air-fuel ratio feedback amount V(F) is changed during an air-fuel ratio feedback control time period as illustrated in FIG. 14. That is, during a learning control time period, the synchronized cylinder is changed so as to determine a leanest cylinder, however, the fluctuation of the air-fuel ratio feedback amount V(F) is large. Contrary to this, during a non-learning control time period, an air-fuel ratio feedback control operation is carried out on the basis of the leanest cylinder, and accordingly, the air-fuel ratio feedback amount V(F) is relatively large but stable. In this case, the control air-fuel ratio becomes on the rich side.

Note that the present invention can be applied to a lean air-fuel ratio feedback control system using a lean mixture sensor.

Figure 15A:
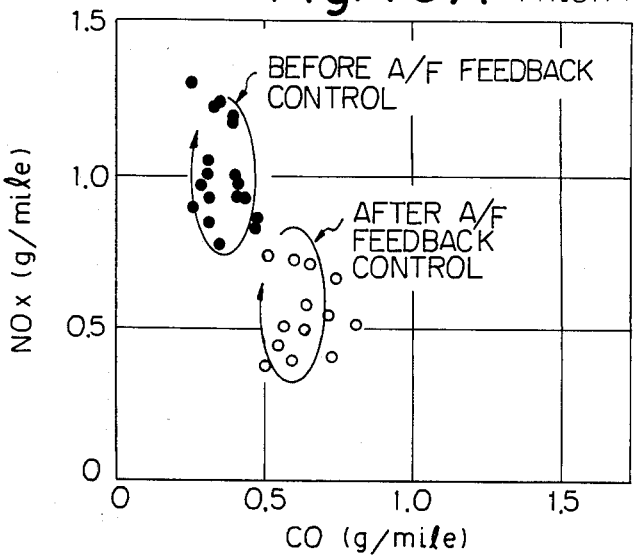
Fig. 15A PRIOR ART
FIGS. 15A and 15B are graphs of the emission characteristics explaining the effect of the present invention.
Figure 15B:
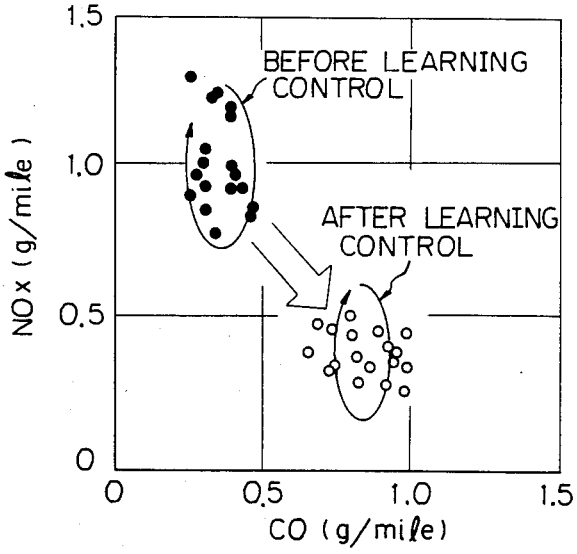

FIGS. 15A and 15B are characteristic diagrams for explaining the effect of the present invention. FIG. 15A shows the exhaust CO and $NO_x$ components of an engine having fluctuation of air-fuel ratio between cylinders, and also shows the exhaust CO and $NO_x$ components thereof after a prior art air-fuel ratio feedback control. That is, in the prior art, since an air-fuel ratio feedback control operation is carried out by using the average air-fuel ratio feedback amount V(F) for the whole of the cylinders, the controlled air-fuel ratio, in this case, becomes on the rich side, thereby decreasing the $NO_x$ component. Contrary to this, according to the present invention, as illustrated in FIG. 15B, the controlled air-fuel ratio becomes on the further rich side after a learning control operation, since an air-fuel ratio feedback control operation is carried out on the basis of a cylinder on the leanest side. Therefore, the CO component is increased but the $NO_x$ component is further decreased, which will be helpful in improving the idling stability.

We claim:

1. A method for controlling the air-fuel ratio in an internal combustion engine having a plurality of cylinders, comprising the steps of:

calculating a base fuel amount in accordance with predetermined parameters of said engine;

generating an air-fuel ratio signal of said engine;

selecting a cylinder from said cylinders;

sampling and holding said air-fuel ratio signal corresponding to said selected cylinder;

calculating an air-fuel ratio feedback amount in accordance with the sampled and held air-fuel ratio signal during a first predetermined engine state;

adjusting the actual air-fuel ratio in accordance with said base fuel amount and said air-fuel ratio feedback amount;

determining a cylinder on the leanest side by changing said selected cylinder during a second predetermined engine state; and setting said cylinder on the leanest side as said selected cylinder during a state other than said second predetermined engine state.

2. A method as set forth in claim 1, wherein said leanest cylinder determining step comprises the steps of:

calculating a mean value of said air-fuel ratio feedback amount for each selected cylinder; and detecting a maximum value from the calculated mean values for said cylinders, thereby determining said cylinder on the leanest side as a cylinder having said maximum value.

3. A method as set forth in claim 2, wherein said mean value calculating step comprises a step of calculating a mean value of four sequential air-fuel ratio feedback amounts immediately before the switching of said air-fuel ratio signal.

4. A method as set forth in claim 1, wherein said air-fuel ratio feedback amount calculating step comprises a step of comparing the value of said air-fuel ratio signal with a predetermined value corresponding to a stoichiometric air-fuel ratio, thereby calculating said air-fuel ratio feedback amount in accordance with the comparison result.

5. A method as set forth in claim 1, wherein said air-fuel ratio feedback amount calculating step comprises a step of comparing the value of said air-fuel ratio signal with a predetermined value corresponding to a lean air-fuel ratio, thereby calculating said air-fuel ratio feedback amount in accordance with the comparison result.

6. An apparatus for controlling the air-fuel ratio in an internal combustion engine having a plurality of cylinders, comprising:

means for calculating a base fuel amount in accordance with predetermined parameters of said engine;

means for generating an air-fuel ratio signal of said engine;

means for selecting a cylinder from said cylinders;

means for sampling and holding said air-fuel ratio signal corresponding to said selected cylinder;

means for calculating an air-fuel ratio feedback amount in accordance with the sampled and held air-fuel ratio signal during a first predetermined engine state;

means for adjusting the actual air-fuel ratio in accordance with said base fuel amount and said air-fuel ratio feedback amount;

means for determining a cylinder on the leanest side by changing said selected cylinder during a second predetermined engine state; and means for setting said cylinder on the leanest side as said selected cylinder during a state other than said second predetermined engine state.

7. An apparatus as set forth in claim 6, wherein said leanest cylinder determining means comprises:

means for calculating a mean value of said air-fuel ratio feedback amount for each selected cylinder; and means for detecting a maximum value from the calculated mean valued for said cylinders, thereby determining said cylinder on the leanest side as a cylinder having said maximum value.

8. An apparatus as set forth in claim 7, wherein said mean value calculating means comprises means for calculating a mean value of four sequential air-fuel ratio feedback amounts immediately before the switching of said air-fuel ratio signal.

9. An apparatus as set forth in claim 6, wherein said air-fuel ratio feedback amount calculating means comprises means for comparing the value of said air-fuel ratio signal with a predetermined value corresponding to a stoichiometric air-fuel ratio, thereby calculating said air-fuel ratio feedback amount in accordance with the comparison result.

10. An apparatus as set forth in claim 6, wherein said air-fuel ratio feedback amount calculating means comprises means for comparing the value of said air-fuel ratio signal with a predetermined value corresponding to a lean air-fuel ratio, thereby calculating said air-fuel ratio feedback amount in accordance with the comparison result.

* * * * *